US005378890A

United States Patent [19]

Wes et al.

[11] Patent Number: 5,378,890

[45] Date of Patent: Jan. 3, 1995

[54] ATMOSPHERIC SCINTILLATION SIMULATOR

[75] Inventors: James A. Wes, Diamond Bar; Harold J. Orlando, Costa Mesa; Steven R. Zammit, Redondo Beach, all of Calif.

[73] Assignee: Northrop Grumman Corporation, Los Angeles, Calif.

[21] Appl. No.: 54,656

[22] Filed: Apr. 23, 1993

[51] Int. Cl.[6] ..... G01M 11/00

[52] U.S. Cl. ..... 250/252.1; 250/504 R; 359/234; 359/235

[58] Field of Search ..... 250/504 R, 252.1 A; 359/235, 234

[56] References Cited

U.S. PATENT DOCUMENTS

| | | | |
|---|---|---|---|
| 1,866,915 | 7/1932 | Tate | 359/235 |
| 3,283,148 | 11/1966 | Schwarz et al. | 250/316.1 |
| 3,857,042 | 12/1974 | LaGrange et al. | 250/495.1 |
| 3,937,945 | 2/1976 | Fitzmaurice et al. | 364/801 |
| 4,173,777 | 11/1979 | Schmit et al. | 362/253 |
| 4,446,363 | 5/1984 | Lakin et al. | 250/252.1 |
| 4,930,352 | 6/1990 | Parker, Jr. et al. | 73/662 |
| 4,996,437 | 2/1991 | Hendrick, Jr. | 250/252.1 |
| 5,079,431 | 1/1992 | Atkinson et al. | 250/493.1 |
| 5,175,432 | 12/1992 | Reitman et al. | 250/332 |

FOREIGN PATENT DOCUMENTS

| | | | |
|---|---|---|---|
| 3-255612 | 11/1991 | Japan | 359/234 |

*Primary Examiner*—Constantine Hannaher

*Attorney, Agent, or Firm*—Terry J. Anderson; Karl J. Hoch, Jr.

[57] ABSTRACT

An apparatus and method for simulating atmospheric scintillation includes a scintillation disk and a motor for rotating the disk at a substantially high speed. The disk has a dense varied pattern of substantially small closely spaced holes. The holes have different sizes and are arranged with a spatial distribution that is gaussian in amplitude and poisson distributed in separation. The motor can spin the disk to produce desired temporal variations as energy from the energy source passes through the holes of the disk.

16 Claims, 2 Drawing Sheets

ATMOSPHERIC SCINTILLATION SIMULATOR

GOVERNMENT LICENSE RIGHTS

The U.S. Government has a paid-up license in this invention and the right in limited circumstances to require the patent owner to license others on reasonable terms as provided for by the terms of contract DAAH01-89-C-A022 awarded by the United States Army.

BACKGROUND OF THE INVENTION

1. Field of the Invention

The present invention relates to simulators and, more particularly, to a simulator adapted to include atmospheric scintillation in its simulation.

2. Prior Art

U.S. Pat. No. 4,446,363 discloses an optical tracking system that produces a simulation of a target and background information. The target is simulated by a mechanical iris, and the background by an image stencil which is perforated by the desired imagery for the background. U.S. Pat. No. 4,996,437 discloses an optical clutter scene simulator to simulate atmospheric clutter produced by a nuclear event. The system includes a projector lens, a source display slide, a scene plane which is actually out of focus with the true focal plane, and a control screen which may be a circular aperture or a variable opacity screen. U.S. Pat. No. 4,173,777 discloses an optical system for simulating the plume produced by a jet aircraft or a missile. The system includes a rotating shutter, a variable power radiation source, a filter to pass only radiation of a plume, a variable iris, and a detector. The various simulations of a plume are described in the abstract. U.S. Pat. No. 5,079,431 discloses a system for testing an infrared sensor by providing a scenario simulator. A target plate for electron beams from guns emits infrared radiation from different locations thereon to simulate an atmospheric scene to be monitored. A collimator and image former project an image onto the sensor. U.S. Pat. No. 3,857,042 discloses a target simulator wherein a moving target is simulated by sequencing the emission of an array of diodes in a controlled manner. U.S. Pat. No. 3,283,148 discloses a calibrator for an infrared system which utilizes a plate with different shaped openings to identify different temperatures in an object field.

SUMMARY OF THE INVENTION

In accordance with one embodiment of the present invention an apparatus for simulating atmospheric scintillation is provided comprising a target source, a scintillation medium, and means for moving the scintillation medium. The target source has a target source output. The scintillation medium is located in a path of the target source output and has a variety of different apertures passing therethrough. The means for moving the scintillation medium can move the medium to thereby vary the target source output passing through the scintillation medium due to movement of the apertures into, through, and out of the target source output path.

In accordance with another embodiment of the present invention, an apparatus for simulating atmospheric scintillation of an energy source is provided comprising a scintillation disk and means for rotating the disk. The scintillation disk has a dense varied pattern of substantially small closely placed holes. The holes have different sizes and spatial distribution that is Gaussian in amplitude and Poisson distributed in separation. The means for rotating can rotate the disk at a substantially high speed to produce desired temporal variations as energy from the energy source passes through the holes of the disk.

In accordance with one method of the present invention, a method for simulating atmospheric scintillation in an infrared test collimator comprises steps of positioning a scintillation disk in front of a target source at a slightly out of focus position, the disk having a dense varied pattern of different holes, the target source having an output that intersects only a portion of the disk; and spinning the disk at a substantially high speed to produce temporal variations as the target source output passes through the holes of the disk as the holes move into, through, and out of the target source output.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
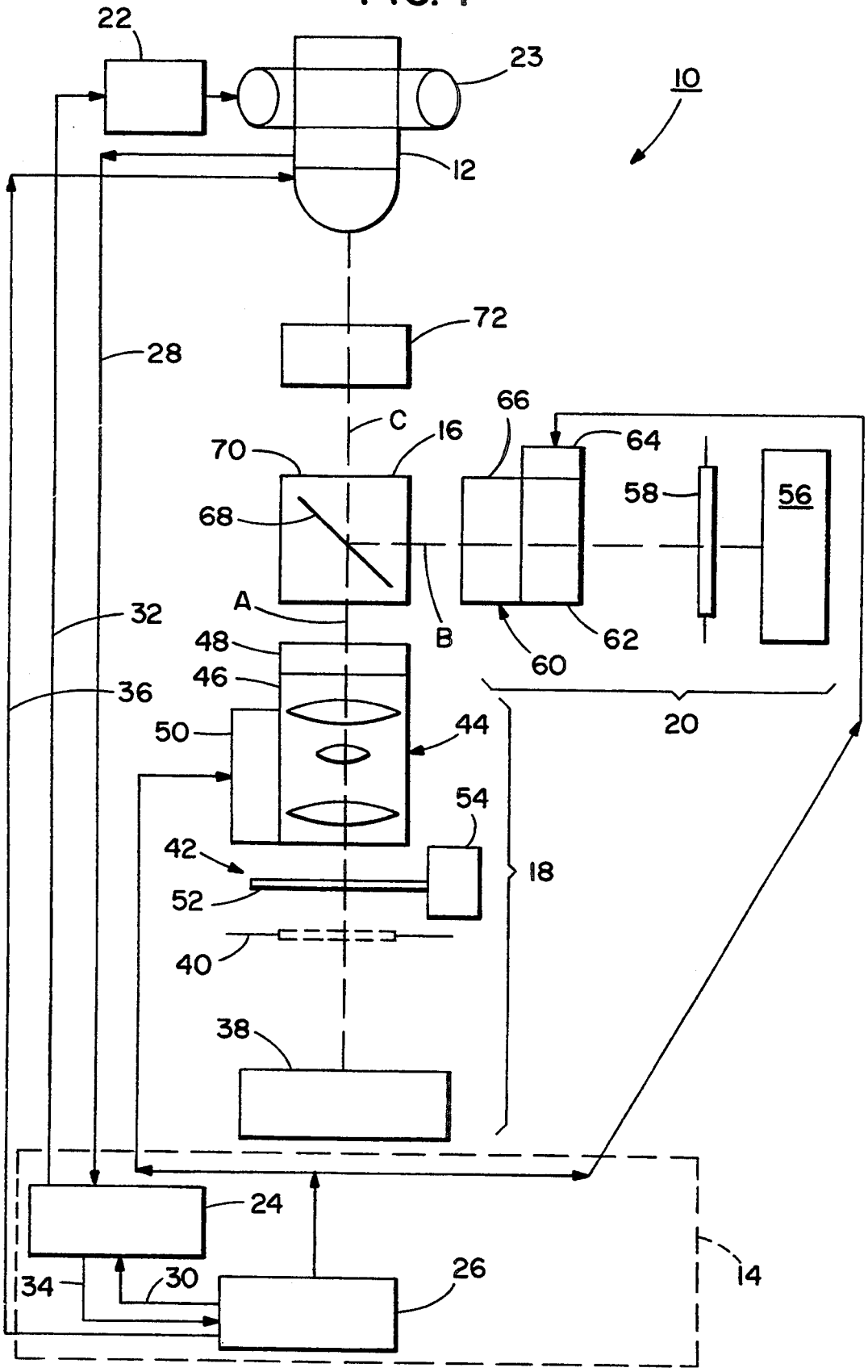
FIG. 1 is a schematic diagram of a simulator incorporating features of the present invention.

FIG. 1 is a schematic diagram of a simulator 10 incorporating features of the present invention. The simulator 10 is generally provided to simulate views that a moving tracking device, such as in a missile or aircraft, would encounter in tracking a target traveling into, through, and/or out of the earth's atmosphere. In particular, the simulator 10 is adapted to track targets based upon radiant energy, such as infrared energy emitted from the plume of a missile. Although the present invention will be described with reference to the single embodiment shown in the drawings, it should be understood that the present invention can be embodied in many alternate forms of embodiment. In addition, any suitable size, shape or type of members or materials could be used.

The simulator 10 generally comprises a seeker head 12, a computer 14, a transmitting/reflecting mirror unit 16, a first source group 18, and a second source group 20. The seeker head 12 is an optical unit of conventional design. The seeker head 12 includes a flight simulator table having a drive 22 and a three-axis platform 23 adapted to simulate roll, pitch and yaw of the seeker head 12. The drive 22 is connected to and controlled by the computer 14. The seeker head 12 is also connected to the computer 14 such that output 28 of optical observations by the seeker head 12 can be transmitted to the computer 14. The computer 14 includes a target calculating subsystem program 24 and a target relative position subsystem program 26. The target calculating subsystem program 24 is adapted to take the output 28 of the seeker head 12 and target relative position input 30 from the target relative position subsystem program 26 to generate drive signals 32 that are output to the driver 22. The driver 22, in turn, moves the seeker head 12 to optically follow a target. Output signals 34, corresponding to signals 32 that the seeker head 12 has been moved, are sent from the target calculating subsystem program 24 to the target relative position subsystem program 26 to recalculate relative position of the seeker head 12 relative to the target. The target relative position subsystem program 26 also outputs signals 36 to the seeker head 12. The signals 36 are forcing function signals adapted to assist in real time flight simulation. Of course, it should be understood that the simulator 10 could be modified to simulate any suitable type of seeker head environment, such as geographically stationary. The first source group 18 generally comprises an energy source 38, a target slide 40, a scintillation system 42 and a combined lens and collimator assembly 44. The energy source 38, in the embodiment shown, is a heat source adapted to generate infrared energy and project it towards the slide 40. The slide 40 is a high resolution photographic slide of a target. The lens and collimator assembly 44 generally comprises a zoom lens 46, a collimator 48, and a zoom drive 50. The zoom lens 46 is preferably a 10:1 zoom adapted to magnify the infrared energy coming from the energy source 38. The drive 50 is connected to the target relative position subsystem program 26 in the computer 14. The computer 14 controls the zoom drive 50 to magnify the image of the target it receives to simulate approach of the seeker head 12 towards the target. The image from the zoom lens 46 exits the assembly 44 through the collimator 48 towards the mirror unit 16 as image A. The scintillation system 42 is located between the slide 40 and the assembly 44. The scintillation system 42 generally comprises a scintillation wheel or disk 52 and a driver 54. Energy from the energy source 38 passes through the target slide 40 and is transformed into a projected image of the target. The projected image from the slide passes through the scintillation wheel 52 which adds the scintillation effect of an image traveling through the atmosphere. The scintillated image then enters the assembly 44. The scintillation system 42 and its operation is described in detail further below. An alternate embodiment of the present invention could comprise the scintillation medium being located between the energy source 38 and the target slide 40.

The second source group 20 generally comprises a second energy source 56, a second slide 58, and a second combined lens and collimator assembly 60. The source 56 is a heat source adapted to generate infrared energy and project it towards the slide 58. The slide 58 is a low resolution photographic slide of multiple targets and/or clutter that might be viewed by a seeker head traveling through the atmosphere or viewed from space. The assembly 60 generally comprises a zoom lens 62, a zoom drive 64, and a collimator 66. The zoom drive 64 is controlled by the computer 14. The zoom lens is preferably a 3:1 zoom lens adapted to magnify the image from the slide 58 to simulate movement of the seeker head 12. The image then travels through the second collimator 66 towards the mirror unit 16 as image B. Of course, any suitable type of multiple target/clutter/background image generating system could be provided.

The transmitting/reflecting mirror unit 16, in the embodiment shown, generally comprises an optical member 68 and a driver 70. The driver 70 is adapted to move the optical member 68 into and out of the path of the two projected images A and B. This type of guillotine optical member eliminates the need for an optical shutter in the path of image B when running tests or calibrations. Of course, rather than the guillotine optical member 68, the unit 16 could include a beam splitter with the second source group 20 including an optical shutter in the pathway of the image B. The first source group 18 could also include an optical shutter in the pathway of the image A. The optical member 68 is adapted to allow the image A to pass directly therethrough towards the seeker head 12 and, reflect the image B towards the seeker head 12. The images A and B combine to form an image C of both the target (with scintillation effects) and the multiple target/clutter/-background images. The image C passes through the third collimator 72 and into the seeker head 12. The driver 70 can move the member 68 out of the path of the images A and B such that only the image A reaches the seeker head 12 for purposes of tests or calibrations.

Figure 2:
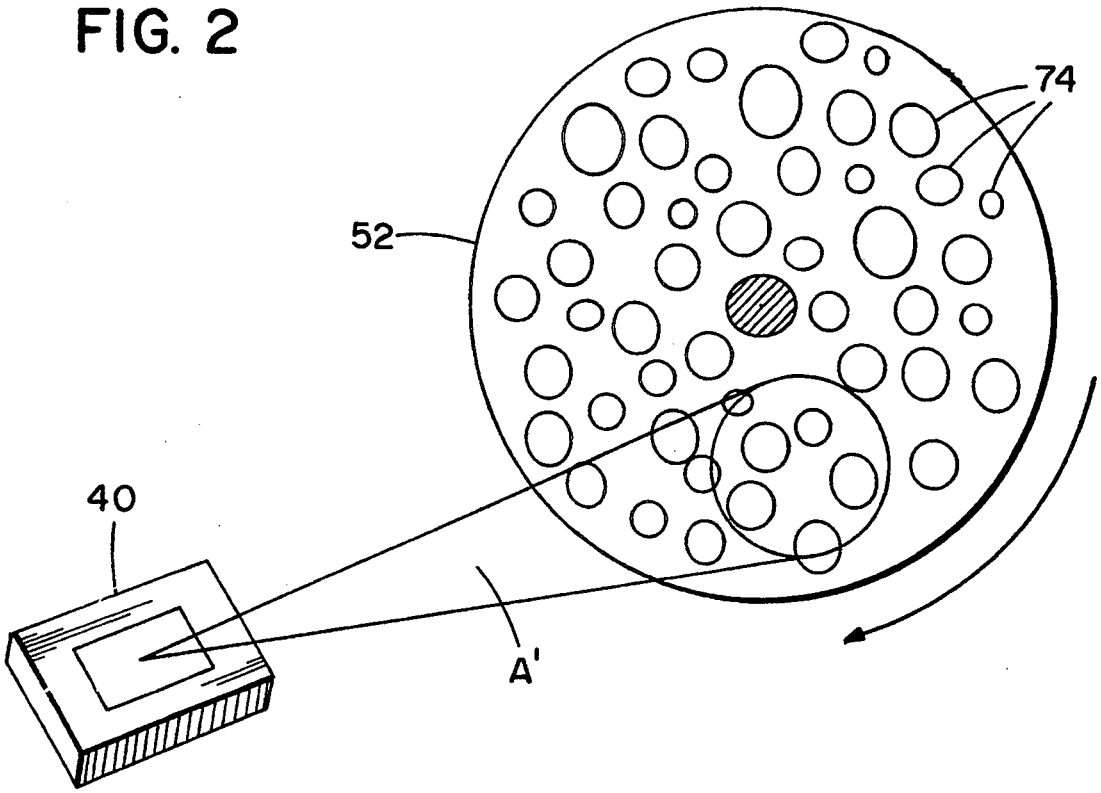
FIG. 2 is a schematic diagram of the scintillation disk and the target slide of the simulator shown in FIG. 1.
Figure 3:
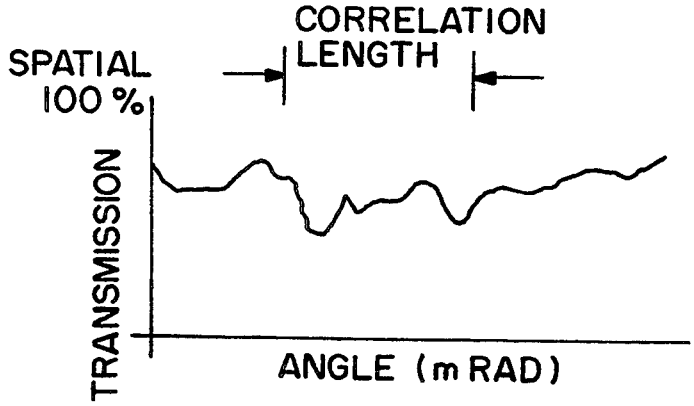
FIG. 3 is a graph of spatial transmission and angle (mRad) of a test simulation.
Figure 4:
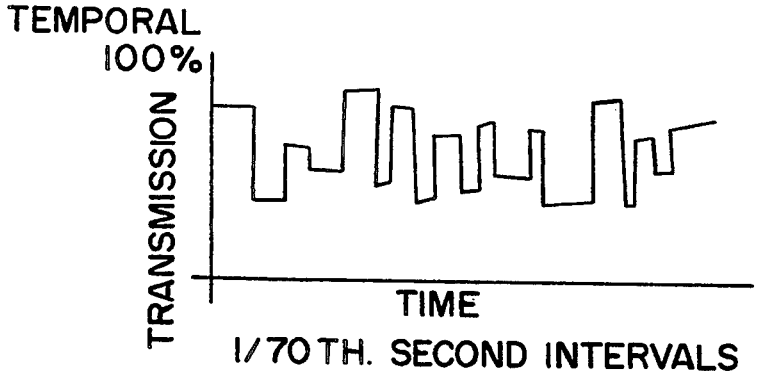
FIG. 4 is a graph of temporal transmission and time in 1/70th second intervals of a test simulation.

Referring now also to FIGS. 2–4, the scintillation wheel 52 is generally comprised of a disk with a plurality of holes 74. The holes 74 are arranged as a dense pattern of small closely placed holes whose density, diameter, and shape vary, as for example the pattern of circles and ellipses shown in FIG. 2, to produce desired spatial and temporal image transmission variations through the wheel 52. In a preferred embodiment, the desired spatial distribution is gaussian in amplitude and poisson distributed in separation. Temporal variations are obtained by spinning the disc as shown by arrow D at a speed which gives the needed temporal variations. The drive 54 is adapted to spin the wheel 52 at a high rate of speed, such as 800 RPM. The image projection A′ from slide 40 passes through the holes 74 of the wheel 52 as the wheel rotates.

During field application of infrared sensors the atmosphere introduces variations in target intensity perceived by the sensor in much the same way as stars are seen to twinkle. These variations do not have much effect on the overall use of the sensor, but can effect the electronic trackers used to point and guide the sensor to its target. This occurs because detail in the target used by the tracker can fade in and out causing the tracker to lose lock on the target or cause variations in what it uses to sense the location of the target. The variations occur both spatially across the target and temporally in a way which is random but can be described statistically. The present invention is adapted to simulate these atmospheric introduced variations or scintillation of targets in the simulator 10. This allows the simulator to more accurately simulate actual seeker head views that would be viewed in the atmosphere. FIG. 3 shows a spatial graph of transmission of the image A′ through the wheel 52 based upon the angle of the wheel. In other words, snap-shots of transmission at each angular position of the wheel 52. The correlation length is a measure of the angular rotation of the wheel 52 that it takes for a hole to pass through the image A′ path. FIG. 4 shows a temporal graph of transmission of a single point of the image A′ through the wheel 52 based upon time measured in 1/70th second intervals.

The present invention offers an ability to make laboratory measurements of sensor trackers which better simulate atmospheric effects. The approach is adaptable to simulate various atmospheric correlation lengths and amplitude variations by the selection of the distribution and size of holes in the metal disc. Various sensor frame rates can be accommodated by changing the disc rotation speed.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. Apparatus for simulating atmospheric scintillation comprising:

a target source having a target source output;

a scintillation medium located in a path of the target source output, the scintillation medium having a variety of different apertures therethrough; and means for moving the scintillation medium to thereby vary the target source output passing through the scintillation medium due to movement of the apertures into, through, and out of the target source output path.

2. An apparatus as in claim 1 wherein the target source is an infrared light source.

3. An apparatus as in claim 1 further comprising a target slide located in front of the target source, the target source output being projected toward a first side of the target slide, and the scintillation medium being located spaced from a second side of the target slide.

4. An apparatus as in claim 1 wherein the scintillation medium comprises a rotatable disk.

5. An apparatus as in claim 4 wherein the means for moving is adapted to spin the disk at a speed to obtain temporal variations.

6. An apparatus as in claim 5 wherein the means for moving is adapted to spin the disk at a speed of at least 800 RPM.

7. An apparatus as in claim 1 wherein the apertures comprise a variety of different size and shape circles and ellipses.

8. An apparatus as in claim 1 wherein the apertures are arranged in a mixed pattern of sizes and spacings between apertures.

9. An apparatus as in claim 8 wherein the apertures having a spatial distribution that is Gaussian in amplitude and poisson distributed in separation.

10. An apparatus for simulating atmospheric scintillation of an energy source, the apparatus comprising:

a scintillation disk having a dense varied pattern of substantially small closely placed holes, the holes having different sizes and spatial distribution that is Gaussian in amplitude and poisson distributed in separation; and means for rotating the disk at a substantially high speed to produce desired temporal variations as energy from the energy source passes through the holes of the disk.

11. An apparatus as in claim 10 wherein the means for rotating is adapted to rotate the disk at least about 800 RPM.

12. An apparatus as in claim 10 wherein the holes comprises circles and ellipses.

13. An apparatus as in claim 10 wherein the disk is located at a position in front of the energy source.

14. A method for simulating atmospheric scintillation in an infrared test collimator comprising steps of:

positioning a scintillation disk in front of a target source, the disk having a dense varied pattern of different holes, the target source having an output that intersects only a portion of the disk; and spinning the disk at a substantially high speed to produce temporal variations as the target source output passes through the holes of the disk as the holes move into, through, and out of the target source output.

15. A method as in claim 14 wherein the step of spinning comprises spinning the disk at least about 800 RPM.

16. A method as in claim 14 further comprising changing a rotation speed of the disk to accommodate a sensor frame rate.

* * * * *